United States Patent [19]

Hauri

[11] 4,332,065

[45] Jun. 1, 1982

[54] THREAD WINDING MACHINE

[75] Inventor: Tobias Hauri, Zug, Switzerland

[73] Assignee: Aktiengesellschaft Fr. Mettler's Söhne Maschinenfabrik, Arth, Switzerland

[21] Appl. No.: 187,625

[22] Filed: Sep. 15, 1980

[30] Foreign Application Priority Data

Sep. 28, 1979 [CH] Switzerland ..... 8778/79

[51] Int. Cl.[3] ..... D02J 3/16; B65H 63/02

[52] U.S. Cl. ..... 28/225; 28/239; 242/36; 242/37 R

[58] Field of Search ..... 242/36, 37, 38, 39, 242/37 A, 35.5 R, 35.5 A, 35.6 R, 35.6 E, 18 R, 18 DD, 1, 131; 28/239, 174, 225; 57/291, 276, 261, 279, 78, 80

[56] References Cited

U.S. PATENT DOCUMENTS

| | | | |
|---|---|---|---|
| 728,983 | 5/1903 | Rushton | 242/38 |
| 943,657 | 12/1909 | Davis et al. | 28/239 X |
| 1,102,214 | 6/1914 | Ewing | 242/37 R |
| 1,958,060 | 5/1934 | McKean | 242/37 R |
| 2,038,856 | 4/1936 | Rudisill | 28/239 |
| 2,665,077 | 1/1954 | Stange | 242/37 R |

FOREIGN PATENT DOCUMENTS

| | | | |
|---|---|---|---|
| 1044015 | 11/1958 | Fed. Rep. of Germany | 28/239 |
| 1115703 | 10/1961 | Fed. Rep. of Germany | 28/239 |
| 879482 | 11/1942 | France | 28/239 |
| 319540 | 4/1957 | Switzerland | 28/239 |
| 325427 | 12/1957 | Switzerland | 28/239 |
| 20025 | of 1907 | United Kingdom | 28/239 |
| 20026 | of 1907 | United Kingdom | 28/239 |
| 196489 | 4/1923 | United Kingdom | 242/37 R |
| 831945 | 4/1960 | United Kingdom | 242/37 R |

*Primary Examiner*—Stanley N. Gilreath
*Attorney, Agent, or Firm*—Werner W. Kleeman

[57] ABSTRACT

Upon rupture of a thread or the like a thread monitor or stop motion moves about a pivot point in clockwise direction, and thus, by means of a release rod, causes an entrainment element to come into engagement with a to-and-fro driven entrainment member. Consequently, an actuation rod is upwardly moved and latched by a support lever in its upper position. Due to this movement a feed bobbin along with the therewith operatively correlated thread guides are lifted, so that the thread travel path is shifted out of the effective region of a singeing burner. Due to the raising of the feed bobbin there is diminished the spacing between such feed bobbin and a winding bobbin. Due to lifting of the actuation rod the winding bobbin, in response to the operation of a pawl and a tooth segment, is raised from a driving cam or grooved drum. The raised position of the feed bobbin facilitates the knotting of the thread.

14 Claims, 3 Drawing Figures

THREAD WINDING MACHINE

BACKGROUND OF THE INVENTION

The present invention relates to thread winding machines and concerns such machines having means to interrupt the winding operation in the event of thread breakage.

In a conventional thread winding machine a feed or supply bobbin delivering the yarn or doubled yarn to be wound is mounted in a fixed, substantially upright position near the ground, while the winding bobbin is mounted in the upper portion of the machine. The thread to be wound is guided by thread guides from the feed bobbin to the winding bobbin, which is driven to wind the thread. A stop motion means or thread monitor engages the thread along its path of travel and stops the driven winding bobbin in the event of a thread breakage. If such a winding machine is equipped with a singeing burner to remove the tips of projecting fibres from the thread, movable thread guides are necessary to move the thread out of the singeing burner when a stoppage occurs. In such a machine, the movable thread guides are mounted on a parallelogram linkage, so as to be movable to move the thread path out of the singeing burner in a transverse direction so that the thread takes up a position parallel to its orginal position.

In order to insert the thread after a thread breakage, or after the insertion of a new feed bobbin, the machine operator must stoop to grasp the end of the thread on the feed bobbin. This is time consuming and also unpleasant for the machine operator, particularly if the machine incorporates a singeing burner, since his head comes close to the hot singeing burner when stooping.

Since the thread must be passed through the constantly heated singeing burner only while it is travelling, so as to avoid burning the thread, but on the other hand, if possible, no piece of thread must be left unsinged, it is left to the skill of the operator to introduce the thread into the burner simultaneously with the starting of winding.

SUMMARY OF THE INVENTION

An object of the present invention is to facilitate the insertion of the thread between the feed bobbin and the winding bobbin when starting the winding machine or after a thread breakage.

According to the present invention, a thread winding machine having a stop motion means or thread monitor operable upon thread breakage includes means controlled by the stop motion means for reducing the spacing between the feed bobbin and the winding bobbin when a thread breakage occurs.

Upon restarting, since the bobbins are re-spaced by lengthening the thread path between the two bobbins during the starting operation, for example after knotting the ends of a broken thread, the thread is always tensioned so that an even starting of the thread winding is rendered possible. Since winding is usually effected from the bottom upwards, the feed bobbin is preferably raised and, as a result, brought closer to the machine operator so that the operator scarcely needs to stoop when inserting the thread or during knotting.

Further advantages are realized when the machine has a singeing burner because the operator no longer has to move close to the singeing burner to grasp the end of a thread and to knot the thread after a breakage.

DESCRIPTION OF THE DRAWINGS

A specific embodiment of the present invention will now be described by way of example and not by way of limitation with reference to the accompanying drawings in which.

DESCRIPTION OF THE PREFERRED EMBODIMENTS

Figure 1:
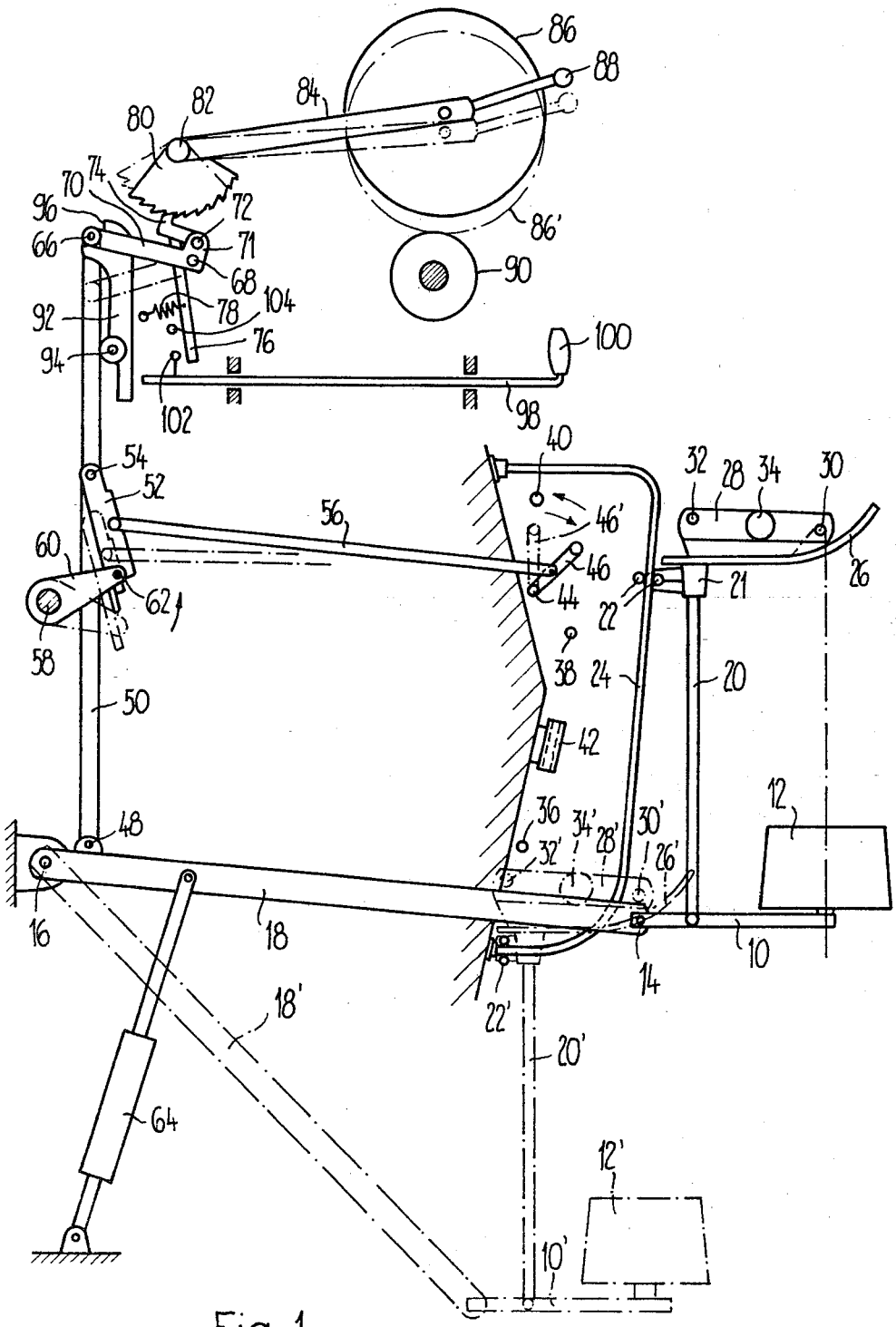
FIG. 1 shows a winding station on a cam-cylinder winding machine equipped with a singeing burner, diagrammatically in side view, after a thread breakage.

With reference to the accompanying drawings, FIG. 1 shows diagrammatically, a feed or supply bobbin 12 disposed upright on a bobbin carrier or support 10. The bobbin carrier 10 is hinged at pivot pin 14 to a pivoted arm 18 pivotable about a stationary pivot point 16. Furthermore, rigidly connected to the bobbin carrier 10 is a guide rod 20, the upper end 21 of which is guided, by means of follower rollers 22, on a curved, stationary guide rail 24. In order to improve the stability, two like curved guide rails may be disposed parallel to one another, in which case follower rollers are associated with each of the two rails.

Rigidly connected to the guide rod 20, at the upper end 21 thereof, is an arcuate protective shield 26 and a carrier or support element 28. Secured to the carrier or support element 28 are two thread guides 30 and 32 and between these a thread brake 34. The first thread guide 30 is positioned immediately above the feed bobbin 12.

Whereas the first thread guide 30 and the second thread guide 32 are fixed relative to the feed bobbin 12, a third thread guide 36, a fourth thread guide 38 and a fifth thread guide 40 are fixed on the frame. Between the third thread guide 36 and the fourth thread guide 38 a singeing burner 42 is disposed in a fixed position in the thread path. A loop or bracket 46, which is pivotable about a fixed pivot point 44, engages the thread between the fourth thread guide 38 and the fifth thread guide 40 and acts as a "stop motion" or thread monitor.

The arm 18 is pivotably connected to an actuating rod 50 as at pivot 48, in the vicinity of its pivot 16. Pivoted on the actuating rod 50, in the middle region thereof, as at pivot point 54, is an entrainment element or lever 52. The entrainment lever 52 is pivotally connected to the stop motion loop or bracket 46 by a release rod 56 defining a coupling element.

Connected to an oscillating shaft 58, which is driven for rotation to and fro, is an arm or lever 60, at the end of which is disposed a sideways projecting pin 62 defining an entrainment member.

Movements of the arm 18 carrying the feed bobbin 12 are damped by a piston and cylinder unit 64 which is pivotally supported on the frame at one end and hinged to the arm 18 at its other end. This unit 64 serves to damp the lowering of the arm 18 into its operating position 18', to be described in more detail later. The reference numerals supplemented by a prime marking indicate elements illustrated in chain-dotted line in the operating position. The same elements are shown in full lines in FIG. 1 in the position which they adopt after a thread breakage or rupture.

Pivoted at the pivot 66 at the upper end of the actuating rod 50 is one arm 70 of a bell-crank or angle lever 70,71, pivoted to the frame as at pivot point 68, the arm 70 being its long arm. Pivoted on a pin 72 at the end of the short arm 71 is a pawl 74. The pawl 74 is ridigly connected to a downwardly directed extension 76 which is biased by a tension spring 78 connected to the frame.

The pawl 74 engages with the teeth of a toothed segment 80 which is rotatably mounted on a shaft 82 and which is rigidly connected to a pair of spaced parallel arms 84. Mounted between the arms 84, at their ends opposite the shaft 82, is a winding bobbin 86. The arm 84, illustrated, carries at its end a handle-like extension 88. Below the winding bobbin 86 there is a cam or grooved cylinder 90 connected to a winding drive (not illustrated).

The pivot 66 at the upper end of the actuating rod 50 comprises a pivot pin which is extended axially and by means of which the actuating rod 50 is held in its upper position by a supporting lever 92 pivoted as at pivot 94. The pivot pin 66 engages in a recess 96 in the supporting lever 92.

An axially displaceable engaging rod 98 carries a handle 100 at its front end and a stop 102 towards its rear end, cooperating with the extension or extension element 76. A stationary stop cooperating with the extension 76 is designated by 104.

Figure 2:
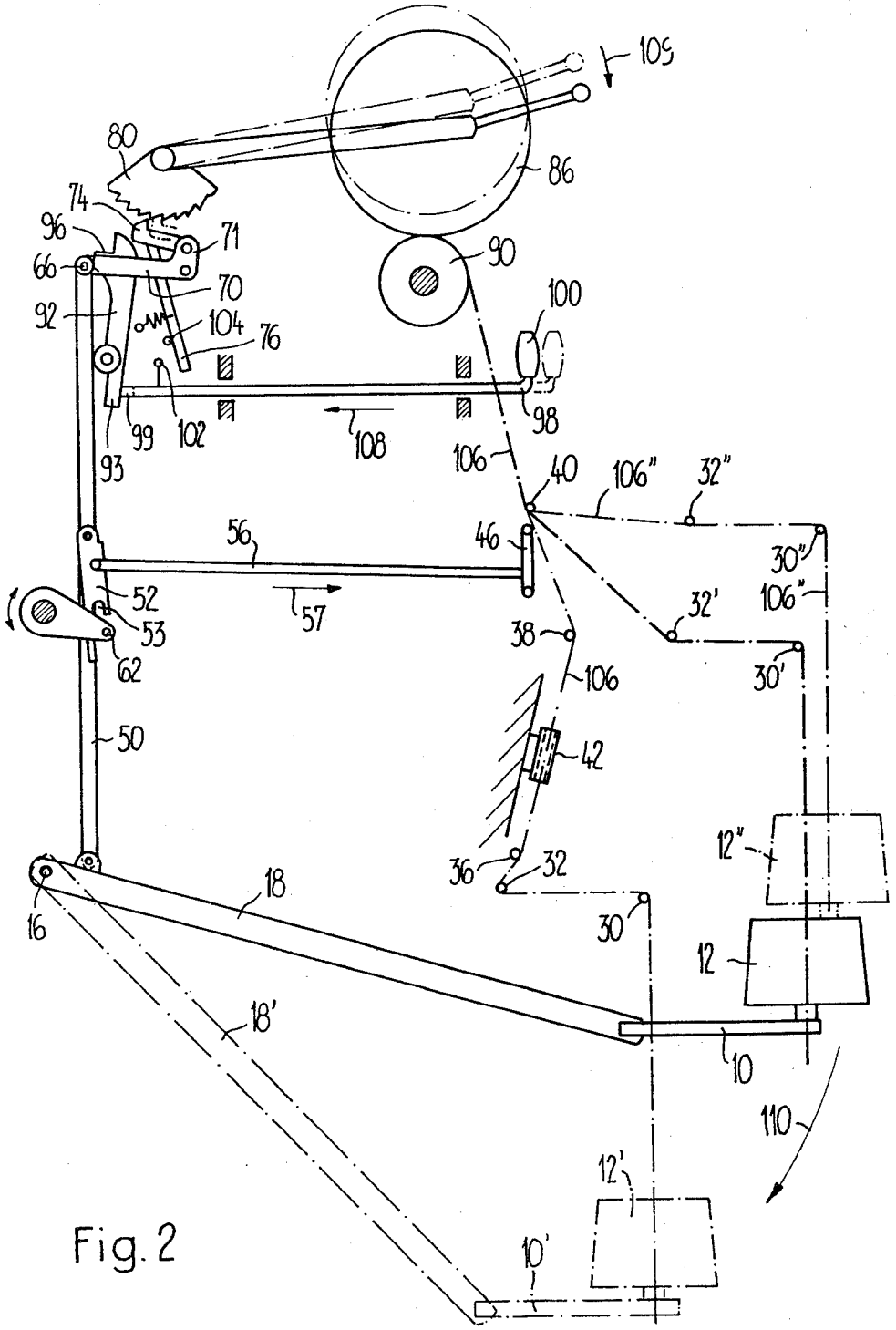
FIG. 2 shows the winding station of FIG. 1 during the starting of winding.

FIG. 2 illustrates how a starting operation takes place. In this Figure, the operation of the linkage and the path of the thread is shown. Various elements illustrated in FIG. 1 are omitted in FIG. 2 for simplification and to improve the clarity. The position 12" of the feed bobbin indicated, is the position which the feed or supply bobbin 12 has adopted after a thread breakage. Associated with this position 12" are the indicated positions 30" and 32" of the two thread guides 30 and 32. In this position, the thread 106 is inserted along the path 106" and knotted to the thread end of the thread on the winding bobbin 86. Then the engagement rod 98 is pushed towards the left in the arrangement illustrated, using its handle 100 until it strikes with its end 99 against the end 93 of the supporting lever 92, moving this in clockwise direction about its pivot 94. As a result, the actuating rod 50, which was hitherto held in its upper position by the lever 92 engaging under the pivot pin 66 is released. The actuating rod 50 and with it also the arm 18 pivoting about the pivot 16, is consequently lowered until the feed bobbin 12 assumes its operating position 12'. During the last third of the lowering movement, the movement is damped by the piston-and-cylinder unit 64 illustrated in FIG. 1.

Simultaneously with the lowering of the feed bobbin 12, the winding bobbin 86 is also lowered until it rests on the rotating cam cylinder 90 to be frictionally driven by the latter. During the lowering of the winding bobbin 86, the pawl 74 is in engagement with the toothed segment 80. Only after the winding bobbin 86 is completely lowered does the pawl 74 come out of engagement with the toothed segment 80, as soon as its extension 76 bears against the stationary stop 104. The withdrawal of the pawl 74 from the toothed segment 80 is effected by the downward movement of the pivot pin 66 via the bell-crank lever 70, 71.

it can be seen from FIG. 2 that the path of the thread 106 is lengthened during the lowering of the feed bobbin 12. Simultaneously, during the lowering of the feed bobbin 12, the thread 106 is introduced into the singeing burner 42 which has a slot, not illustrated, at its front. The linkage connected to the actuating rod 50 is so dimensioned that the thread 106 is accelerated at the moment when it is introduced into the singeing burner 42 as will be explained.

The fixed third and fourth thread guides 36 and 38 serve to guide the thread 106 through the singeing burner 42. The thread guide 38 and the fifth fixed thread guide 40 serve to tension the thread 106 in that region where the stop motion or thread monitor 46 normally engages the thread. The release rod 56 coupled to the stop motion 46 is prestressed or biased in the direction of the arrow 57 so as to move in the direction 57 in the event of a thread breakage.

The entrainment element or lever 52 coupled to the release rod 56 comprises a recess 53 in which the reciprocating entrainment member 62 engages in the case of release.

While the arrow 108 (FIG. 2) indicates the direction of actuation of the engagement rod 98, the arrows 109 and 110 indicate the movements of the winding bobbin 86 and the feed bobbin 12 respectively, caused by the actuation of the rod 98.

FIG. 2 shows the simple path 106" which the thread 106 has to adopt during its insertion. Because of the raised position 12" of the feed bobbin 12 and the raised positions 30" and 32" of the thread guides 30 and 32 which are always disposed in a fixed reference position relative to the feed bobbin 12, this arrangement is in a favourable position for the insertion of thread so that the operator scarcely has to stoop if at all.

As a result of the guide rod 20, guided on the curved guide rail or rails 24 and illustrated in FIG. 1, the feed bobbin 12 retains a position substantially parallel to itself during the raising and lowering movements.

The arrangement of the pawl 74 has the effect that the winding bobbin 86 during the release in the event of a thread breakage always has its peripheral surface lifted a substantially constant amount above the cam cylinder 90, regardless of its external diameter. As a result of this arrangement, assurance is also provided that the winding bobbin 86 re-contacts the cam cylinder 90 to be driven by this at the appropriate moment during the lowering operation, so as to fulfil the condition already mentioned, namely that the thread 106 is accelerated as it is introduced into the singeing burner 42.

Figure 3:
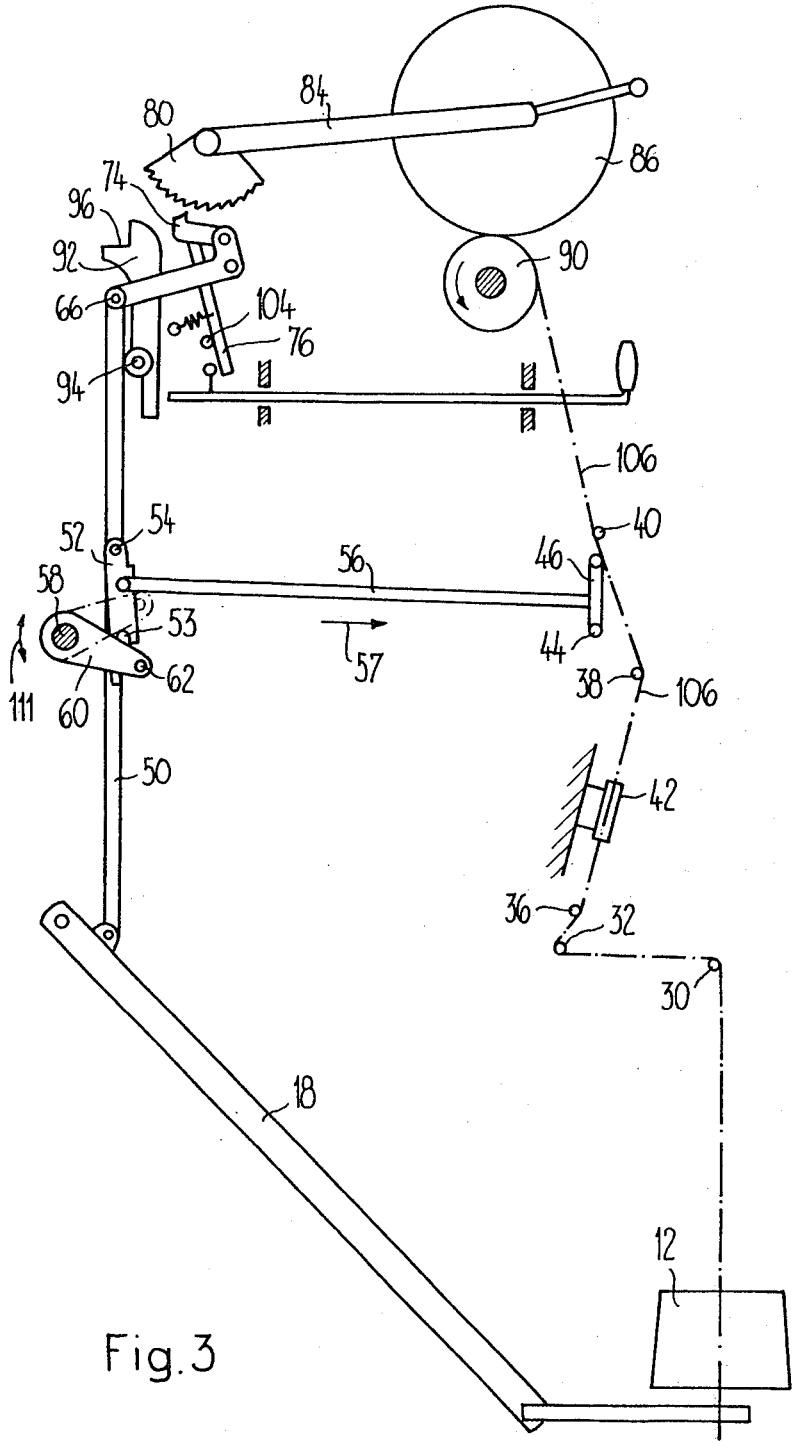
FIG. 3 shows the winding station of FIG. 1 during winding.

FIG. 3 shows the arrangement in the winding position. The actuating rod 50 and hence the arm 18 are now lowered into their lowest position. The release drive composed of the elements 58, 60 and 62 and reciprocating in the direction of the arrow 111 moves the pin 62 to and fro along a circular arc out of contact with the entrainment lever 52. It can also be seen from FIG. 3 that the pawl 74 is out of the range of engagement with the toothed segment 80 because the extension 76 of the pawl 74 bears against the stationary stop 104. If the thread breaks, the loop or bracket 46 of the stop motion pivots about its pivot point 44 in a clockwise direction so that the release rod 56, which is coupled to the entrainment lever 52 can move in the direction of the arrow 57. In the course of this movement, the release rod 56 entrains the lever 52 which is then pivoted in a counter-clockwise direction about its pivot 54. This brings the recess 53 in the lever 52 into the path of movement of the entrainment pin 62. The pin 62 enters the recess 53 and lifts the actuating rod 50. Through the actuating rod 50, on the one hand, the arm 18 and hence the feed bobbin 12 are lifted. On the other hand, through the actuating rod 50, the pawl 74 is moved to lift the winding bobbin 86 from the cam cylinder 90 via the toothed segment 80 and the arm 84. The actuating rod 50 is moved upwards until it is supported by its pivot pin 66 entering the recess 96 in the supporting lever 92. The supporting lever 92 is hinged in a counter-clockwise direction about its pivot 94 by hinging means (not illustrated) and is rotated clockwise by the pin 66 to allow the pin to move upwardly past the lever to the level of its recess 96, whereupon the hinging means rotates the lever 92 counter-clockwise to engage the supporting lever 92 under the pin 66.

If, in the position caused by a thread breakage, as shown in FIG. 1, the winding bobbin 86 was raised too far by manipulation of the handle-like extension 88, in which case the pawl 74 can jump over the teeth of the toothed segment 80, or if the full bobbin 86 has been exchanged for an empty bobbin not illustrated, then it is necessary to lower the arm 84 again to a suitable distance from the cam cylinder 90. In order to achieve this, the engagement rod 98 must be pulled out towards the right using the handle 100 in the arrangement illustrated so that the stop 102 rigidly connected to the engagement rod 98 moves the pawl 74, through its extension 76, in counter-clockwise direction and so temporarily brings it out of engagement with the toothed segment 80. Then the winding bobbin 86 can be moved the necessary distance from the cam cylinder 90 by means of the handle-like extension 88.

While there are shown and described present preferred embodiments of the invention, it is to be distinctly understood that the invention is not limited thereto, but may be otherwise variously embodied and practiced within the scope of the following claims.

I claim:

1. A thread winding machine comprising:

a winding bobbin;

drive means for driving said winding bobbin;

a feed bobbin for supplying thread to said winding bobbin;

a moveable carrier for supporting said feed bobbin;

means for moveably mounting said carrier;

means defining a thread path between said feed bobbin and said winding bobbin;

means for monitoring the passage of the thread along the thread path;

said thread monitoring means serving for disconnecting the drive means from the winding bobbin in the event of thread breakage; and means responsive to the action of said thread monitoring means for moving the feed bobbin carrier towards the winding bobbin upon occurrence of thread breakage.

2. The thread winding machine as defined in claim 1, wherein:

said mounting means for said carrier comprises a pivotal arm having opposed ends;

a stationary pivot with which there is pivotably connected one end of said pivotal arm; and the other end of said pivotal arm supporting said carrier.

3. The thread winding machine as defined in claim 2, wherein:

said responsive means for moving said carrier comprises:

an actuating rod operatively connected by means of said pivotal arm with said carrier;

an entrainment element pivotably connected with said actuation rod;

a to-and-fro driven entrainment member positioned to cooperate with said entrainment element;

said thread monitoring means comprising a moveable thread monitoring bracket;

a coupling element for interconnecting said moveable thread monitoring bracket with said entrainment element; and said coupling element, upon occurrence of a thread breakage, enabling said driven entrainment member to engage with said entrainment element in order to thereby actuate said actuation rod for moving the carrier towards the winding bobbin.

4. The thread winding machine as defined in claim 2, further including:

means for pivotably connecting said carrier with said other end of said pivotal arm of said mounting means; and guide means for guiding said carrier during movement thereof in a direction essentially parallel to itself.

5. The thread winding machine as defined in claim 4, wherein:

said guide means comprise at least one stationary curved guide rail; and follower means mounted on said carrier and engaging with said stationary guide rail.

6. The thread winding machine as defined in claim 5, wherein:

said means defining said thread path includes thread guides;

a guide rod mounted on said carrier;

said guide rod extending towards the winding bobbin and bearing a support element; and said support element having mounted thereat said follower means and at least one of said thread guides.

7. The thread winding machine as defined in claim 6, wherein:

said means defining said thread path comprises said at least one thread guide and two stationary thread guides arranged in spaced relationship from one another;

a stationary singeing burner interposed between said stationary thread guides; and said stationary singeing burner being disposed in a position such that said at least one thread guide removes the thread from contact with said two stationary thread guides and from an effective region of said singeing burner upon occurrence of thread breakage.

8. The thread winding machine as defined in claim 7, further including:

a protective shield mounted for movement into a position located between the singeing burner and a machine operator when the thread is moved out of the effective region of the singeing burner.

9. The thread winding machine as defined in claim 1, further including:

damping means for damping return movement of the pivotal arm from a raised position into a lower position where the feed bobbin is ready for winding thread onto the winding bobbin.

10. A machine as defined in claim 1, further including:

linkage means connected to a pawl which engages in a toothed segment connected to the winding bobbin for lifting the winding bobbin out of contact with its drive means.

11. A machine as claimed in claim 10, further including means for holding the pawl out of engagement with the toothed segment during a thread winding operation.

12. A thread winding machine comprising:

a feed bobbin for carrying a supply of thread to be wound onto a winding bobbin;

a winding bobbin for receiving the thread from the feed bobbin;

drive means for driving said winding bobbin;

thread monitoring means for monitoring the passage of thread as it is being woundoff said feed bobbin onto said winding bobbin and for interrupting said drive means for the winding bobbin in the event of thread rupture;

means controlled by and responsive to said thread monitoring means for raisingly moving said feed bobbin from a thread winding position into an ineffectual position in the event of said thread rupture;

carrier means for the feed bobbin;

a pivotal arm supporting the feed bobbin carrier means;

thread guide means coacting with said feed bobbin for guiding the thread delivered therefrom;

coupling means for operatively coupling the pivotal arm to said responsive means for raising the feed bobbin carrier means and said thread guide means towards the winding bobbin upon occurrence of thread rupture;

a singeing burner arranged along a winding path of travel of the thread which is being unwound from the feed bobbin and onto said winding bobbin; and said thread guide means moving the thread out of said winding path of travel of the thread during which time the thread moves through said singeing burner when said responsive means raises said feed carrier means and said thread guide means towards said winding bobbin.

13. The thread winding machine as defined in claim 12, further including:

a protective shield mounted for movement along with said thread guide means into a position located between the singeing burner and a machine operator when the thread is moved by said thread guide means out of an effective region of the singeing burner.

14. The thread winding machine as defined in claim 12, further including:

damping means for damping a return movement of the pivotal arm into a position where the feed bobbin is in a position for winding thread onto the winding bobbin.

* * * * *